US010105283B2

(12) United States Patent
Pinkus et al.

(10) Patent No.: US 10,105,283 B2
(45) Date of Patent: Oct. 23, 2018

(54) ELONGATED STEAMHEAD FOR A STEAM BATH

(71) Applicant: SUSSMAN AUTOMATIC CORPORATION, Long Island City, NY (US)

(72) Inventors: Michael J. Pinkus, Pleasantville, NY (US); Peter A. Titolo, Kings Park, NY (US)

(73) Assignee: SUSSMAN AUTOMATIC CORPORATION, Long Island City, NY (US)

( * ) Notice: Subject to any disclaimer, the term of this patent is extended or adjusted under 35 U.S.C. 154(b) by 460 days.

(21) Appl. No.: 14/804,477

(22) Filed: Jul. 21, 2015

(65) Prior Publication Data

US 2017/0020782 A1 Jan. 26, 2017

(51) Int. Cl.
*A61H 33/06* (2006.01)
*A61H 33/00* (2006.01)

(52) U.S. Cl.
CPC ..... *A61H 33/6052* (2013.01); *A61H 33/06* (2013.01); *A61H 2033/068* (2013.01); *A61H 2201/0188* (2013.01); *A61H 2201/5012* (2013.01); *A61H 2201/5082* (2013.01)

(58) Field of Classification Search
CPC ..... A61H 33/063; A61H 33/065; F24F 6/18; D06F 73/00
USPC .... 239/499, 500, 502, 509, 518, 522; 222/3, 222/146.4
See application file for complete search history.

(56) References Cited

U.S. PATENT DOCUMENTS 3,007,178 A * 11/1961 Altman ..... A47K 3/28 392/397
3,503,558 A * 3/1970 Galiulo ..... A47L 9/0081 239/499
5,435,020 A 7/1995 Maskell et al.
5,805,765 A * 9/1998 Altman ..... F22B 1/284 392/324
5,822,675 A * 10/1998 Paquet ..... H05B 3/148 219/543
6,505,781 B2 1/2003 Altman
(Continued)

FOREIGN PATENT DOCUMENTS

CN 201200604 Y 3/2009
CN 203609641 U 5/2014
(Continued)

*Primary Examiner* — Janie Loeppke
(74) *Attorney, Agent, or Firm* — Haug Partners LLP; William S. Frommer

(57) ABSTRACT

The dispensing chamber of the steamhead is mounted between the studs within the wall of a steam bath enclosure. The chamber is isolated from the environment and includes an elongated steam outlet extending outwardly from the chamber, through an opening in the wall. The rectangular outer edge of the outlet is flush with the interior surface of the wall and is the only portion of the chamber visible from inside the enclosure. The outer edge of the outlet is shaped to coordinate with the appearance of a linear drain. It also allows the steam to be dispensed over a wider area. The outlet has a steam flow capacity greater than the steam flow capacity of the inlet such that steam expands within the chamber as the velocity of the steam is reduced. Internal baffles reduce noise. Light sources may be associated with the chamber.

30 Claims, 4 Drawing Sheets

(56) References Cited

U.S. PATENT DOCUMENTS

| | | | | |
|---|---|---|---|---|
| 6,577,815 | B1 * | 6/2003 | Wu | A61H 33/063 392/394 |
| 2005/0121540 | A1 * | 6/2005 | Torigoe | A61H 33/063 239/289 |
| 2007/0223894 | A1 * | 9/2007 | Cheung | A61H 33/063 392/405 |
| 2010/0024117 | A1 * | 2/2010 | Fujii | A61H 33/063 4/524 |
| 2012/0291194 | A1 | 11/2012 | Lee | |
| 2013/0097773 | A1 * | 4/2013 | Pinkus | F21V 21/00 4/524 |

FOREIGN PATENT DOCUMENTS

| | | | |
|---|---|---|---|
| DE | 102010048402 | B4 | 10/2013 |
| EP | 1484044 | B1 | 3/2009 |
| GB | 2095105 | A | 9/1982 |
| JP | H05285188 | A | 11/1993 |
| JP | H0780039 | A | 3/1995 |

* cited by examiner

ELONGATED STEAMHEAD FOR A STEAM BATH

BACKGROUND OF THE INVENTION

1. Field of the Invention

The present invention relates to steamhead for use in residential and commercial steam baths and more particularly, a steamhead including a steam dispensing chamber with an elongated steam outlet, designed to be mounted within the wall of the steam bath enclosure, which improves the distribution of steam throughout the steam bath enclosure and visually coordinates with a linear drain.

2. Description of Prior Art Including Information Disclosed Under 37 CFR 1.97 and 1.98

Steamheads for use in residential and commercial steam baths of various types are known in the art. Steam baths commonly include a steam generator which is located outside the steam bath enclosure. The steam generator provides steam to a steamhead located within an enclosure. In a residential steam bath, the enclosure is usually a shower stall. Commercial steam baths typically have a larger enclosure in the form of a steam room within which the steamhead is located. In both cases, the steamhead is attached to the end of a steam feed pipe connected to the outlet of the steam generator. The feed pipe extends through the wall of the steam bath enclosure such that steam can be delivered to the steamhead.

The purpose of the steamhead is to dispense the steam from the steam feed pipe into the steam bath enclosure. Often the steamhead has a steam outlet in the form of a small round port which directs the steam downwardly toward the steam bath floor such that a person in the steam bath enclosure is not burned by steam exiting steamhead. Because the steam outlet port is the same diameter as the feed pipe, in commercial steam baths the safety issue is particularly important because steam may exit the steam outlet under pressure.

Recently, it has become fashionable to create steam bath enclosures with linear floor drains instead of the round floor drains which are conventional. However, as far as we are aware there are no commercially available steamheads in which the visible portion of the steamhead coordinates with the appearance of a linear drain.

As far as we are aware there are no commercially available steamheads which are not visible to a person within the steam bath enclosure, except for the outer edge of the steam outlet, which terminates at the steam bath enclosure wall.

As far as we are aware there are no commercially available steamheads which are engineered to be mounted outside of the steam bath enclosure such that a person within the steam bath enclosure cannot accidentally come in contact with the steamhead when it is in use and get burned.

Moreover, as far as we are aware there are no commercially available steamheads which improve the distribution of the steam throughout the steam bath enclosure. More particularly, as far as we are aware there are no commercially available steamheads that allow steam to expand before it exits the steam outlet. As far as we are aware there are no commercially available steamheads which reduce the velocity of the steam before it enters the steam bath enclosure. As far as we are aware there are no commercially available steamheads which dispense steam over a wide area. As far as we are aware there are no commercially available steamheads which reduce the noise that steam creates as it leaves the feed pipe and enters the steam bath.

As far as we are aware there are no commercially available steamheads which include a light source. As far as we are aware there are no commercially available steamheads in which the light source indicates when the steam generator is operating. As far as we are aware there are no commercially available steamheads in which a light source emits anti-bacterial light.

It is therefore a prime object of the present invention to provide an elongated steamhead for a steam bath.

It is another object of the present invention to provide an elongated steamhead for a steam bath which improves the distribution of the steam throughout the steam bath enclosure.

It is another object of the present invention to provide an elongated steamhead for a steam bath having an elongated steam outlet.

It is another object of the present invention to provide an elongated steamhead for a steam bath having a dispensing chamber designed to be mounted outside of the steam bath enclosure.

It is another object of the present invention to provide an elongated steamhead for a steam bath having a steam outlet shaped to coordinate with the appearance of a linear drain.

It is another object of the present invention to provide an elongated steamhead for a steam bath that allows steam to expand before it exits the steam outlet.

It is another object of the present invention to provide an elongated steamhead for a steam bath that reduces the velocity of the steam as it exits the steam outlet.

It is another object of the present invention to provide an elongated steamhead for a steam bath that dispenses steam over a wide area.

It is another object of the present invention to provide an elongated steamhead for a steam bath that reduces the noise steam creates as it leaves the feed pipe and exits the steam outlet.

It is another object of the present invention to provide an elongated steamhead for a steam bath that includes a light source.

It is another object of the present invention to provide an elongated steamhead for a steam bath wherein the light source indicates when the steam generator is operational.

It is another object of the present invention to provide an elongated steamhead for a steam bath having a light source which emits anti-bacterial light.

BRIEF SUMMARY OF THE INVENTION

The above noted objects are achieved by the present invention, which, in general, is directed to a steamhead for a steam bath including a dispensing chamber having a first wall. The chamber is isolated from the environment and includes a steam inlet connected to receive steam from a steam generator and an elongated steam outlet extending outwardly from the first chamber wall. The steam outlet has a steam flow capacity greater than the steam flow capacity of the steam inlet such that steam expands within the chamber before exiting the steam outlet.

The steamhead has at least one baffle, preferably multiple baffles, situated within in the dispensing chamber between the steam inlet and the steam outlet.

The chamber has a second wall. At least some of the baffles extend into the chamber from the interior surface of the first chamber wall and from the interior surface of a second chamber wall. The interior surface of the first chamber wall faces the interior surface of the second chamber wall. The baffles which extend from the interior surface of the first chamber wall are interleaved with the baffles which extend from the interior surface of the second chamber wall.

The chamber has a bottom wall. At least one of the baffles is inclined toward the bottom wall. The bottom wall has an interior surface which is inclined toward the steam outlet.

The chamber has a top wall. The steam inlet is situated in the top wall, proximate the center thereof.

The chamber has a side including a rubber gasket and an end cap which is situated adjacent the gasket. The end cap has an outwardly extending member adapted to attach the chamber to a structural member.

The steamhead may have one or more light sources associated with it. The light sources may indicate when the steam generator is operational or when the steamhead is hot. For example, a red light may indicate that the steamhead is hot and may emit steam whereas a blue or green light may indicate that the steamhead is not hot and will not emit steam. Alternatively, one or more light sources that emit light having an anti-bacterial effect may be employed.

In accordance with another aspect of the present invention, a steamhead is provided for a steam bath adapted to be mounted within the wall of a steam bath enclosure. The steamhead includes a dispensing chamber having a first wall. The chamber is isolated from the environment and includes a steam inlet connected to receive steam from a steam generator and an elongated steam outlet extending outwardly from the first chamber wall, through an opening in the shower bath enclosure wall. The outlet has a steam flow capacity greater than the steam flow capacity of the steam inlet such that the steam expands within the chamber before exiting the steam outlet through the steam bath enclosure wall.

At least one baffle, and preferably multiple baffles, is situated in the dispensing chamber between the steam inlet and the steam outlet. At least some of the baffles extend into the chamber from the interior surface of the first chamber wall. At least some of the baffles extend into the chamber from the interior surface of a second chamber wall. The first chamber wall faces the second chamber wall. The baffles which extend from the interior surface of first chamber wall are interleaved with the baffles which extend from the interior surface of the second chamber wall.

The chamber has a bottom wall. At least one of the baffles is inclined toward the bottom wall. The interior surface of the bottom wall is inclined toward the steam outlet.

The chamber has a top wall. The steam inlet is situated in the top wall, preferably proximate the center thereof.

The chamber has a side including a rubber gasket and an end cap situated adjacent the gasket. The end cap includes an outwardly extending member adapted to attach the steamhead to a structural member, such as a stud, situated within the steam bath enclosure wall.

The steam outlet is defined in part by an outer edge. The outer edge of the steam outlet is the only portion of the chamber visible from the interior of the steam bath enclosure, when the steamhead is situated within the steam bath enclosure wall. The outer edge of the steam outlet is preferably in the same or substantially the same plane as the interior surface of the steam bath enclosure wall.

The visible edge of the steam outlet is substantially rectangular to coordinate with the appearance of a linear drain.

The steamhead may have one or more light sources associated with it. The light sources may indicate when the steam generator is operational or when the steamhead is hot. For example, a red light may indicate that the steamhead is hot and may emit steam whereas a blue or green light may indicate that the steamhead is not hot and will not emit steam. Alternatively, one or more light sources that emit light having an anti-bacterial effect may be employed.

In accordance with another aspect of the present invention, a steamhead for a steam bath is provided. The steamhead has a dispensing chamber including a first baffle and a second baffle. The chamber is isolated from the environment and includes a steam inlet connected to receive steam from a steam generator and an elongated steam outlet extending outwardly from the front wall of the chamber. The chamber is formed of two parts. One of the chamber parts includes the front wall of the chamber, the top wall of the chamber, the first baffle and the upper portion of the steam outlet. The second chamber part includes the bottom wall of the chamber, the rear wall of the chamber, the second baffle and the lower portion of the steam outlet.

The chamber parts are formed of anodized aluminum and may be extruded.

The chamber has a side including an end cap adapted to be attached to each of the chamber parts and which functions to retain the chamber parts together.

The top wall of the chamber includes a downwardly extending member. The rear wall of the chamber has a channel adapted to receive the member. When the chamber parts are assembled, the member is received in the channel to seal the front wall of the chamber and the rear wall.

BRIEF DESCRIPTION OF THE SEVERAL VIEWS OF DRAWINGS

To these and to such other objects that may hereinafter appears, the present invention relates to an elongated steamhead for a steam bath as described in detail in the following specification and recited in the annexed claims, taken together with the accompanying drawings, in which like numerals refer to like parts and in which:

DETAILED DESCRIPTION OF THE INVENTION

Figure 1:
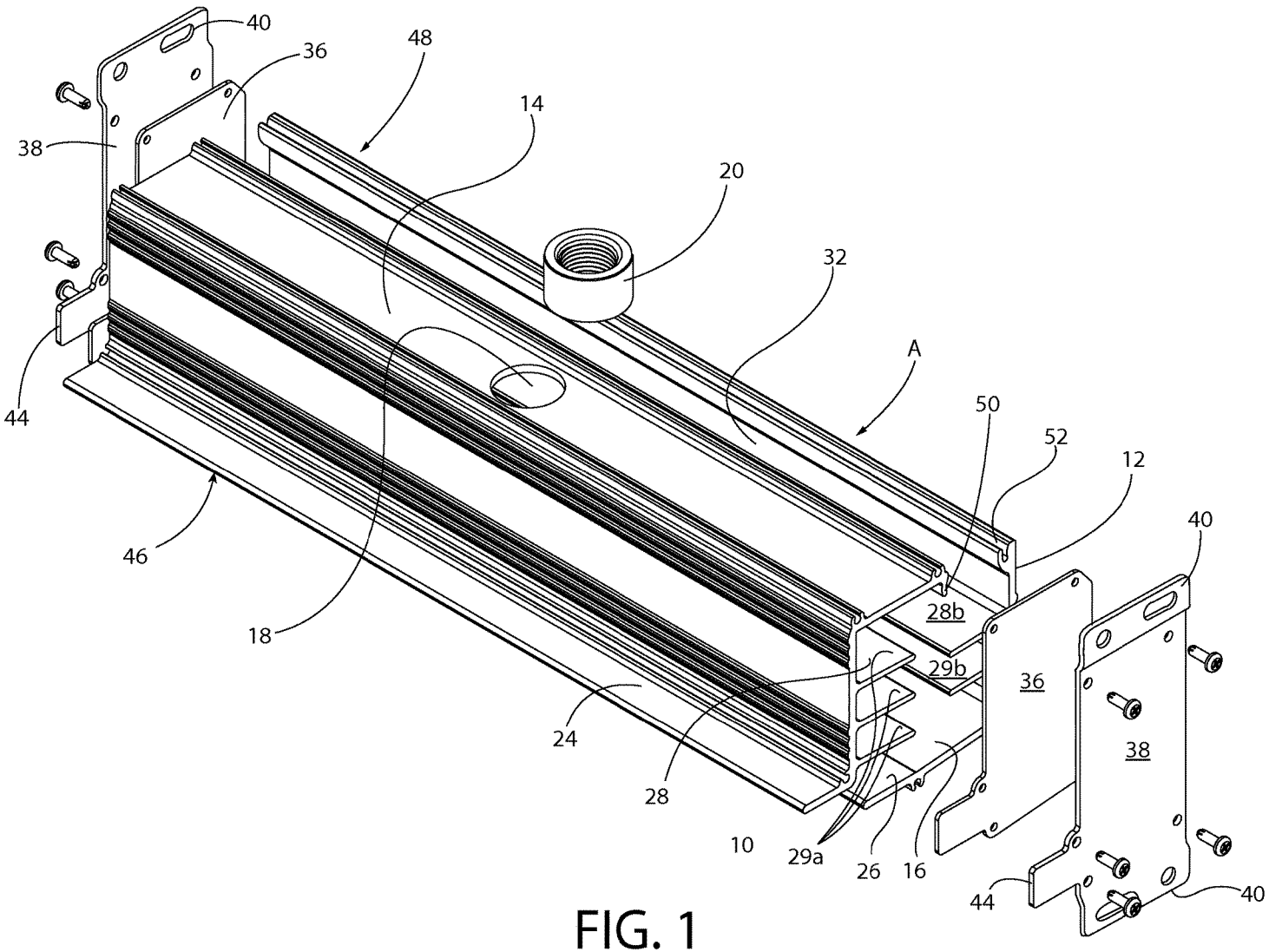
FIG. 1 is an exploded perspective view of the steamhead of the present invention.

As depicted in the drawings, the present invention relates to a steamhead including an elongated dispensing chamber, generally designated A, designed for use in a residential or commercial steam bath and adapted to be installed within the wall of a steam bath enclosure, generally designated B.

Dispensing chamber A improves the distribution of the steam throughout the steam bath enclosure. It functions as a manifold, allowing steam to expand as it passes through the chamber. At the same time, the chamber functions to reduce the velocity of the steam.

The chamber includes a front wall 10, a rear wall 12, a top wall 14 and a bottom wall 16. Walls 10, 12, 14 and 16, along with the sides of the chamber, define an interior space which is isolated from the environment.

Top wall 14 has a centrally located round steam inlet 18. An internally threaded fitting 20 may be mounted on top wall 14 in alignment with steam inlet 18, as shown in the drawings. Fitting 20 is fabricated to receive the externally threaded end of a feed pipe or conduit (not shown) connected to receive steam from a steam generator (not shown). Alternatively, the rim of top wall 14 which defines steam inlet 18 may be internally threaded to receive the end of the steam generator feed pipe, thus eliminating the necessity for the fitting.

Chamber A also includes an elongated steam outlet 22 extending outwardly from front wall 10 for a distance equal to the thickness of the wall of steam bath enclosure B within which the steamhead will be located. Because of its elongated shape and dimensions, the steam outlet 22 allows the steam to exit the chamber over a wide area.

Steam outlet 22 is rectangular in shape and is defined in part by members 24 and 26 which extend outwardly from the plane of front wall 10 of the chamber and form the top and bottom of the steam outlet, respectively.

Steam outlet 22 has substantially larger cross-sectional area than steam inlet 18 and thus has a steam flow capacity substantially greater than the steam flow capacity of steam inlet 18. Accordingly, chamber A allows steam from the steam generator to expand before exiting steam outlet 22 while at the same time reducing the velocity of the steam.

The steamhead also has at least one, and preferably multiple, baffles 29 situated within chamber A, between steam inlet 18 and steam outlet 22. Baffles 29 define the path in which steam from steam inlet 18 must travel within chamber A to steam outlet 22. Baffles 29 reduce the noise made by the steam as it moves through the chamber.

Figure 5:
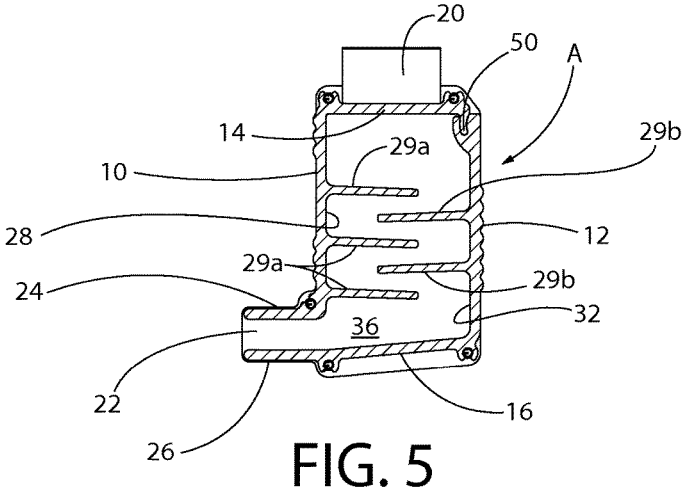
FIG. 5 is a cross-sectional view of the steamhead of the present invention, taken along line 5-5 of FIG. 3.

As illustrated in FIGS. 1 and 5, the front wall 10 of chamber A has an interior surface 28. One set of baffles 29*a* extend from surface 28 into chamber A. The rear wall 12 of chamber A has an interior surface 32. A second set of baffles 29*b* extend into chamber A from surface 32. As best seen in FIG. 5, surface 28 faces surface 32 such that the baffles 29*a* and the baffles 29*b* extend in opposite directions, toward each other.

Baffles 29*a* are spaced from each other. Likewise, baffles 29*b* are spaced from each other. Baffles 29*a* are vertically offset from baffles 29*b* such that the baffles from the respective baffle sets 29*a*, 29*b* are interleaved with each other, creating a circuitous path through which steam must travel as it expands and moves through chamber A from steam inlet 18 to steam outlet 22.

Bottom wall 16 is inclined toward steam outlet 22 such that any water which accumulates at the bottom of chamber A will be caused by gravity to flow towards and exit through steam outlet 22.

In addition, the upper surface of at least one of the baffles 29, and preferably all of the baffles 29, is inclined toward bottom wall 16. Thus, gravity will cause any water which accumulates on the upper surfaces of the baffles 29 to eventually flow down to wall 18 and out of steam outlet 22.

Each of the sides of chamber A is sealed with a rubber gasket 36. Each gasket 36 is held in place by an end cap 38 which is situated adjacent to the gasket. Each end cap 38 has mounting portions 40 extending upwardly and downwardly beyond the top and bottom walls of chamber A, respectively. Each mounting portion 40 includes openings 42 adapted to receive screws for mounting the steamhead to a structural member.

Figure 6:
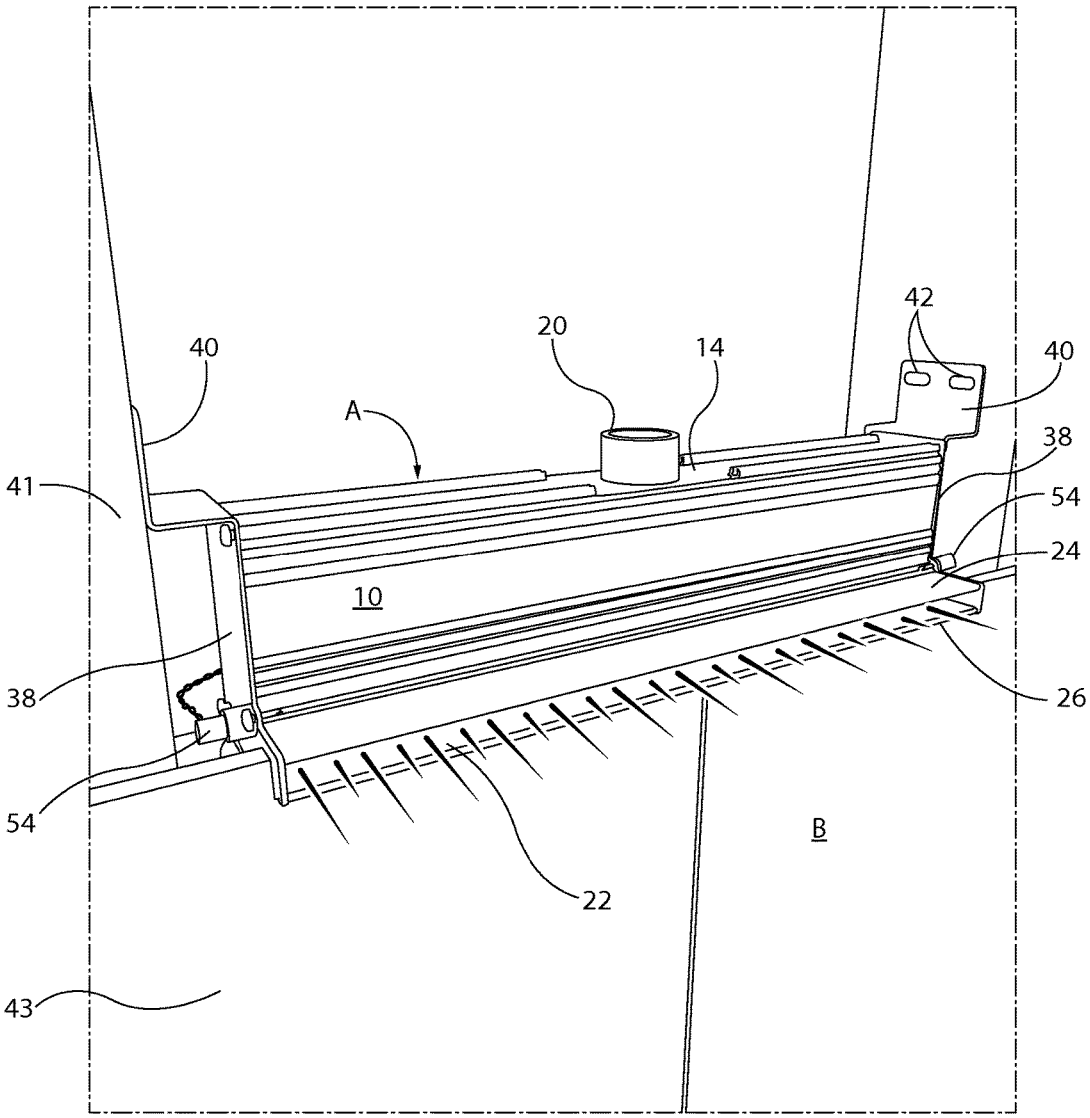
FIG. 6 is a perspective view of the wall of a steam bath enclosure with a portion cut away to show the steamhead of the present invention mounted between the studs within the wall and light sources mounted on the opposite sides of the dispensing chamber.

As seen in FIG. 6, end caps 38 permit the steamhead to be securely mounted between the vertical studs 41 within wall 43 of steam bath enclosure B. Preferably, chamber A is sized to fit between conventionally spaced studs.

Figure 2:
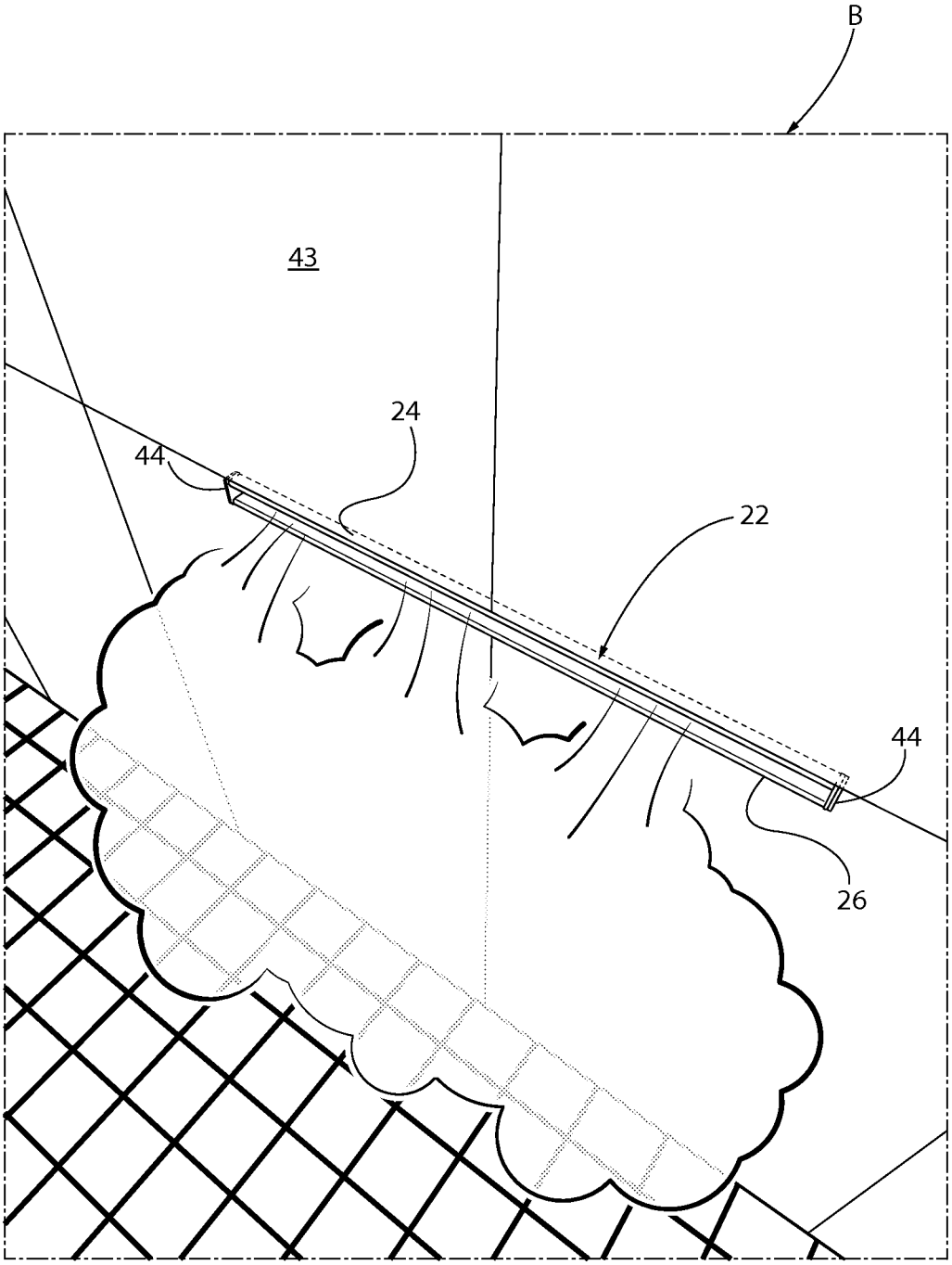
FIG. 2 is an environmental view of the wall and floor of a steam bath enclosure showing the steamhead of the present invention, as it would appear when installed.
Figure 3:
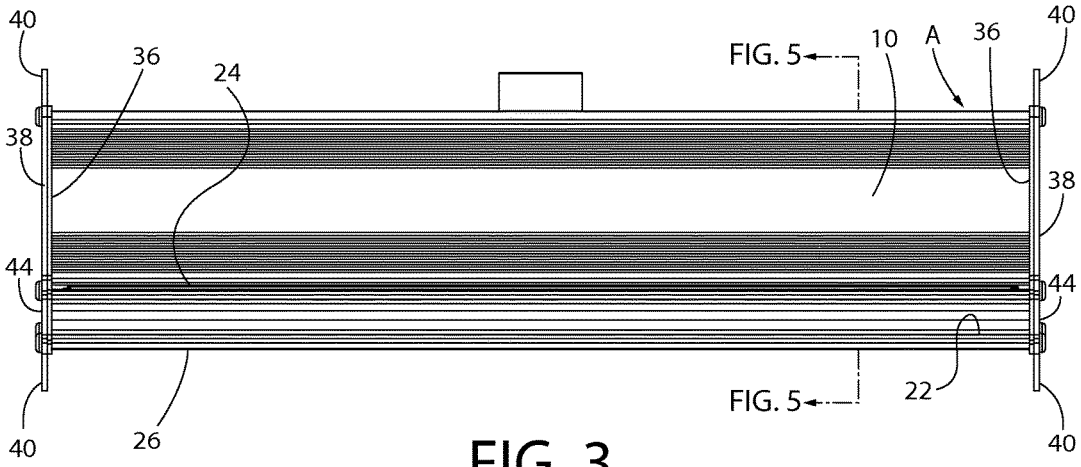
FIG. 3 is an elevation view of the front of the steamhead of the present invention.
Figure 4:
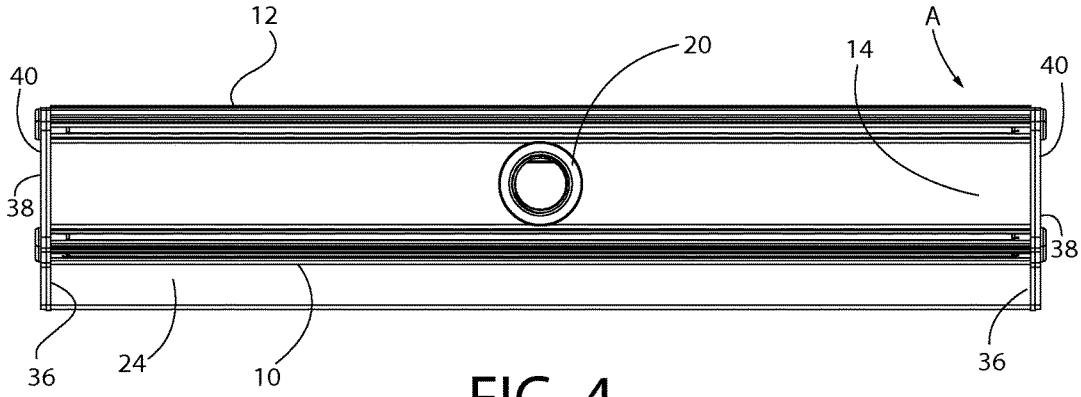
FIG. 4 is an elevation view of the top of the steamhead of the present invention.

As seen in FIG. 2, the steamhead is mounted within wall 43 of the steam bath enclosure instead of inside the enclosure, as is the case with conventional steamheads. Members 24, 26, and the forward portions 44 of end caps 38, define the rectangular outer edge of steam outlet 22. The plane of the outer edge of the steam outlet is situated in substantially the same as the plane of the interior surface of wall 43 of the steam bath enclosure B. Thus, as seen in FIGS. 2 and 6, when installed, the outer edge of the steam outlet is substantially flush with the interior surface of wall 43. The only physical portion of the steamhead which is visible from inside the steam bath enclosure is the rectangular outer edge of the steam outlet.

As is best seen in FIG. 1, the steamhead is formed of two extruded parts 46, 48. Part 46 includes front wall 10, top wall 14, baffles 29*a* and member 24 which forms the upper portion of the steam outlet. Part 48 includes bottom wall 16, rear wall 18, baffles 29*b* and member 26 which forms the lower portion of the steam outlet.

The chamber parts 46, 48 and end caps 38 (with gaskets 36) are assembled to form chamber A. The end caps 38 are attached to each of the chamber parts by screws and function to retain the chamber parts together.

Top wall 14 includes a downwardly extending member 50 situated at the rear the thereof. Rear wall 12 has a channel 52 shaped to securely to receive member 50 and to seal the front wall and the rear wall together, when the chamber parts are assembled.

The chamber parts are preferably composed of anodized aluminum.

One or more light sources 54 may be associated with the steamhead. The light sources may take the form of a single LED or a cluster of LEDs. Preferably, one light source is located at each end of chamber A to provide even light distribution through steam outlet 22, as seen in FIG. 6.

An opening is created in each of the end caps 38, and in the aligned gasket 36, in order to accommodate a light source which extends into the interior of the distribution chamber. Each light source is connected to the control circuitry of the steam generator or to a temperature sensor associated with the dispensing chamber. Accordingly, the light source can be energized when the steam generator is operational or when the temperature of the dispensing chamber exceeds a predetermined level.

Multiple light sources 54 may be employed. The light sources may emit different color lights. For example, one light source may emit a red light to indicate that the steam generator is operating or that the temperature of the dispensing chamber is above a predetermined level and may emit steam. Another light source may emit a different color light (green or blue) indicating that the steam generator is not operational or that the steam generator is not operational or that the temperature of the dispensing chamber is below a predetermined level and will not emit steam.

Alternatively, the light sources may take the form of ultraviolet LEDs which generate light at a wavelength which kills bacteria.

Because of the high temperature within the dispensing chamber, high temperature ceramic packaged LEDs fabricated to withstand the steam temperatures could be used if properly sealed against moisture. However, to avoid that problem, the LEDs may be situated remotely from the dispensing chamber so they are not exposed to high temperature. In that instance, light emitted from the LEDs could be transferred to the interior of the chamber by means of light pipes which extend through the end caps of the chamber.

While only a single preferred embodiment of the present invention has been disclosed for purposes of illustration, it is obvious that many modifications and variations could be made thereto. It is intended to cover all of those modifications and variations which fall within the scope of the present invention, as defined by the following claims.

We claim:

1. A steamhead for a steam bath enclosure defined in part by an enclosure wall supported by spaced studs, the enclosure wall having an interior surface facing the steam bath enclosure, an exterior surface facing away from the enclosure, and an opening, said steamhead comprising a dispensing chamber adapted to be mounted between studs of the enclosure wall and defining a completely enclosed interior space within the chamber to contain steam except for a steam inlet connected to receive steam from a steam generator and an elongated steam outlet having an exit plane, said dispensing chamber comprising first and second chamber walls defining, in part, said dispensing chamber, said steam outlet extending outwardly from said first chamber wall, and plural baffles secured to at least one of the first and second chamber walls to create a circuitous path through which steam travels from the steam inlet through the dispensing chamber to the steam outlet at a reduced rate of flow, wherein the exit plane of the steam outlet is substantially flush with the interior surface of the enclosure wall when the steamhead is mounted to said enclosure wall, and wherein said steam outlet has a steam flow capacity greater than the steam flow capacity of said steam inlet such that the steam expands within the chamber before exiting said steam outlet.

2. The steamhead of claim 1 wherein at least some of said baffles extend into said chamber from said first chamber wall.

3. The steamhead of claim 2 wherein at least some of said baffles extend into said chamber from said second chamber wall.

4. The steamhead of claim 3 wherein said baffles which extend from said first chamber wall are interleaved with said baffles which extend from said second chamber wall.

5. The steamhead of claim 1 wherein said chamber has a bottom wall and wherein at least one of said baffles is inclined toward said bottom wall.

6. The steamhead of claim 1 wherein said chamber has a bottom wall with an interior surface, wherein said interior surface of said bottom wall is inclined toward said steam outlet.

7. The steamhead of claim 1 wherein said chamber has a top wall and wherein said steam inlet is situated in said top wall.

8. The steamhead of claim 1 wherein said chamber has a top wall and wherein said steam inlet is situated proximate the center of said top wall.

9. The steamhead of claim 1 wherein said chamber comprises an exterior side comprising a gasket and an end cap situated adjacent said gasket.

10. The steamhead of claim 9 wherein said end cap comprises an outwardly extending member adapted to attach said chamber to one of the studs.

11. The steamhead of claim 9 wherein said gasket is made of rubber.

12. The steamhead of claim 1 further comprising at least one light source.

13. The steamhead of claim 12 wherein said light source indicates when the steam generator is operational or that the temperature of said chamber exceeds a predetermined level.

14. The steamhead of claim 12 wherein said light source emits light having an anti-bacterial effect.

15. A steamhead assembly for a steam bath adapted to be mounted within a steam bath enclosure wall having a thickness, the steamhead assembly comprising a dispensing chamber having a first wall facing the interior of the steam bath enclosure, said dispensing chamber defining a completely enclosed interior space within the chamber to contain steam except for a steam inlet connected to receive steam from a steam generator and an elongated steam outlet extending in a lengthwise direction and protruding outwardly from said first chamber wall by an amount substantially equal to said thickness to exit through an opening in the enclosure wall and having an exit plane, and end mounts disposed at opposite ends of the dispensing chamber in the lengthwise direction, the end mounts being adapted to secure the steamhead assembly to a structural member of the steam bath enclosure wall, wherein said exit plane of said elongated steam outlet is substantially flush with the wall of the enclosure as seen from the interior of the steam bath enclosure.

16. The steamhead assembly of claim 15 further comprising at least one baffle situated in said chamber between said steam inlet and said steam outlet.

17. The steamhead assembly of claim 16 wherein said chamber has a bottom wall and wherein said at least one baffle is inclined toward said bottom wall.

18. The steamhead assembly of claim 15 further comprising multiple spaced baffles situated in said chamber between said steam inlet and said steam outlet.

19. The steamhead assembly of claim 18 wherein said first chamber wall has an interior surface and wherein at least some of said baffles extend into said chamber from said interior surface of said first chamber wall.

20. The steamhead assembly of claim 19 wherein said chamber has a second wall with an interior surface and wherein at least some of said baffles extend into said chamber from said interior surface of said second chamber wall.

21. The steamhead assembly of claim 20 wherein said interior surface of said first chamber wall faces said interior surface of said second chamber wall.

22. The steamhead assembly of claim 20 wherein said baffles which extend from said interior surface of said first chamber wall are interleaved with said baffles which extend from said interior surface of said second chamber wall.

23. The steamhead assembly of claim 18 wherein said chamber has a bottom wall and wherein at least one of said baffles is inclined toward said bottom wall.

24. The steamhead assembly of claim 15 wherein said chamber has a bottom wall with an interior surface, wherein said interior surface of said bottom wall is inclined toward said steam outlet.

25. The steamhead assembly of claim 15 wherein said chamber has a top wall and wherein said steam inlet is situated in said top wall.

26. The steamhead assembly of claim 15 wherein said chamber has a top wall and wherein said steam inlet is situated proximate to the center of said top wall.

27. The steamhead assembly of claim 15 wherein said elongated steam outlet is substantially rectangular.

28. The steamhead assembly of claim 15 further comprising a light source.

29. The steamhead assembly of claim 28 wherein said light source indicates that the steam generator is operational or that the temperature of said chamber exceeds a predetermined level.

30. The steamhead assembly of claim 28 wherein said light source emits light with an anti-bacterial effect.

* * * * *